US006279277B1

(12) United States Patent
Zittmayr

(10) Patent No.: US 6,279,277 B1
(45) Date of Patent: Aug. 28, 2001

(54) SPIRAL RING-TYPE CONSTRUCTION WITH A SINGLE SPIRAL CENTRAL STAIRWELL

(76) Inventor: Johannes Zittmayr, Bernhardgutstrasse 11, Enns A-4470 (AT)

( * ) Notice: Subject to any disclaimer, the term of this patent is extended or adjusted under 35 U.S.C. 154(b) by 0 days.

(21) Appl. No.: 09/381,077

(22) PCT Filed: Jan. 21, 1998

(86) PCT No.: PCT/AT98/00012

§ 371 Date: Sep. 13, 1999

§ 102(e) Date: Sep. 13, 1999

(87) PCT Pub. No.: WO98/41715

PCT Pub. Date: Sep. 24, 1998

(30) Foreign Application Priority Data

Mar. 14, 1997 (AT) ..... 440/97

(51) Int. Cl.[7] ..... B65B 1/04
(52) U.S. Cl. ..... 52/236.1; 52/236.4; 52/185
(58) Field of Search ..... 52/175, 176, 185, 52/187, 236.1, 236.4, 236.2

(56) References Cited

U.S. PATENT DOCUMENTS 1,321,100 * 11/1919 Higgins ..... 52/176

FOREIGN PATENT DOCUMENTS

| | | | | |
|---|---|---|---|---|
| 20 65 437 | | 9/1973 | (DE) . | |
| 0 118 723 | | 9/1984 | (EP) . | |
| 595244 | * | 9/1925 | (FR) | 52/176 |
| 6612040 | * | 1/1968 | (NL) | 52/176 |
| WO9218725 | | 10/1992 | (WO) . | |

OTHER PUBLICATIONS

Carla Debets: "Een spiraalwoning met twaalf niveau's" Bouwwereld, Bd. 86, Nr. 24, Nov. 30, 1990.

* cited by examiner

*Primary Examiner*—Peter M. Cuomo
*Assistant Examiner*—Jerry A. Anderson
(74) *Attorney, Agent, or Firm*—Collard & Roe, P.C.

(57) ABSTRACT

A building comprises a plurality of multi-story building sectors, each building sector having a trapezoidal horizontal cross section and the building sectors forming a polygonal ring enclosing an inner courtyard, a staircase housing in the inner courtyard, a spiral staircase in the staircase housing, the staircase winding circularly in an upward direction, and connecting passages radiating from the staircase to respective ones of the stories of the building sectors at staggered vertical distances. Successive stories in the upwardly winding direction of the spiral staircase in adjacent ones of the building sectors are vertically staggered from each other by the same vertical distances as the connecting passages.

4 Claims, 2 Drawing Sheets

SPIRAL RING-TYPE CONSTRUCTION WITH A SINGLE SPIRAL CENTRAL STAIRWELL

BACKGROUND OF THE INVENTION

1. Field of the Invention

The present invention relates to a polygonal building structure enclosing an inner courtyard in which a central staircase is connected by passages to the surrounding building structure.

2. Description of the Prior Art

In polygonal buildings of this type, the individual building sectors and the stories in these building sectors are not laid out in such a manner that the initial structure need not be altered with a change of its size and where, moreover, all the building sectors and stories may be reached at any level from the central staircase.

The building construction according to German patent No. 2,065,437 comprises building sectors of rectangular horizontal cross section, rather than the trapezoidal construction, which makes ready expansion possible. Nor does it involve a spiral construction matching the vertically upwardly winding staircase to vertically staggered stories in the adjacent building sectors.

European patent No. 118,723 discloses a parking garage having a cylindrical outer wall and an upwardly winding spiral driveway.

SUMMARY OF THE INVENTION

It is one of the objects of this invention to provide a polygonally shaped building with building sectors facing south, west, north and east.

It is another object of the invention to provide a multi-story building structure composed of trapezoidal building sectors with vertically staggered stories which form a spiral and forming a ring around a central staircase. Such a ring, divided into trapezoidal building sectors, may change its circumference and may be expanded to any desired size without changing the basic structure of the building sectors. If successive stories are so staggered vertically that they form an upwardly winding spiral, a three-dimensional structure is obtained which maintains its basic structure at any size. The polygonal shape may be a triangle or any other polygon, such as a pentagon or a hexagon. To obtain the desired vertical staggering of the stories in the adjacent building sectors, the ground floors in the adjacent building sectors continuously increase in height. Connecting passages radiate from the central staircase to the vertically staggered stories.

The above and other objects are accomplished according to the present invention with a building comprising a plurality of multi-story building sectors, each building sector having a trapezoidal horizontal cross section and the building sectors forming a polygonal ring enclosing an inner courtyard, a staircase housing in the inner courtyard, a spiral staircase in the staircase housing, the staircase winding circularly in an upward direction, and connecting passages radiating from the staircase to respective ones of the stories of the building sectors at staggered vertical distances. Successive stories in the upwardly winding direction of the spiral staircase in adjacent ones of the building sectors are vertically staggered from each other by the same vertical distances as the connecting passages.

According to one feature, the connecting passages are uniformly distributed around the staircase housing. The building sectors may be arranged about a common center and extend over identical angles with respect to the common center. If desired, at least one group of building sectors has a different distance from the common center than other building sectors.

BRIEF DESCRIPTION OF THE DRAWING

The above and other objects, advantages and features of this invention will now be described in more detail in connection with certain preferred embodiments thereof illustrated in the accompanying schematic drawing wherein.

DETAILED DESCRIPTION OF THE PREFERRED EMBODIMENTS

Figure 1:
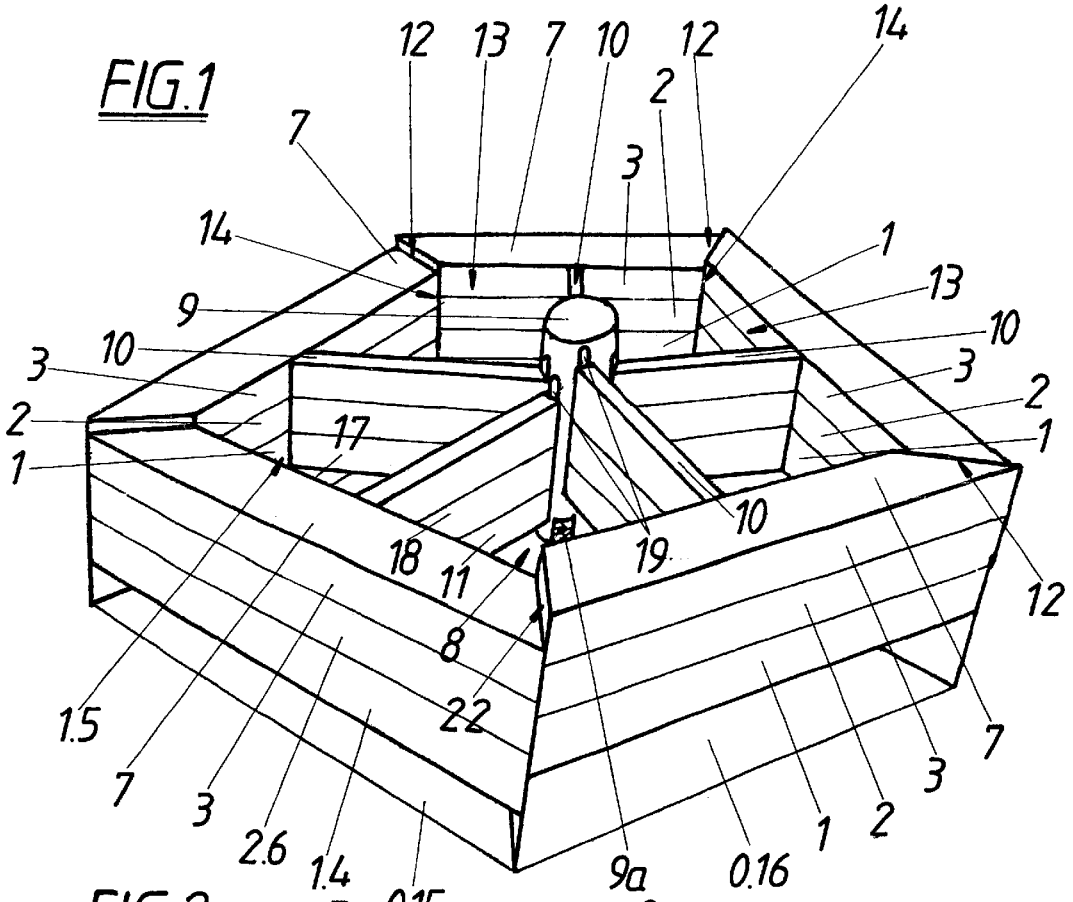
FIG. 1 is a perspective view of a pentagon-shaped building comprising building sectors with four stories.

In the drawing, like reference numerals designate like parts functioning in a like manner in all figures.

Figure 2:
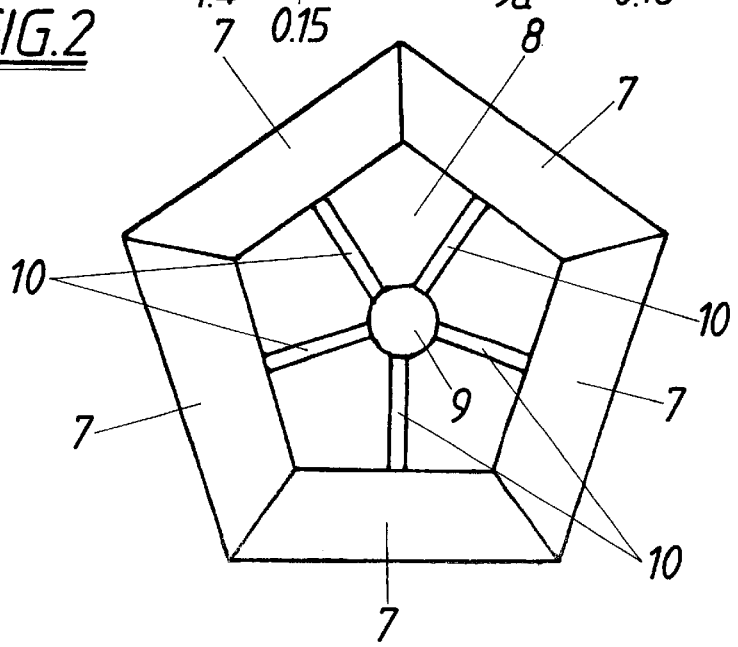
FIG. 2 is a plan view of the building of FIG. 1.

Referring first to FIGS. 1 and 2, there is shown a building comprising a plurality of multi-story building sectors 7. Each building sector has a trapezoidal horizontal cross section and the building sectors form a pentagonal ring enclosing inner courtyard 8. Staircase housing 9 in the inner courtyard holds spiral staircase 9*a*, the staircase winding circularly in an upward direction. Connecting passages 10 radiate from the staircase to respective ones of stories 1, 2 and 3 of building sectors 7 at staggered vertical distances. Successive stories in the upwardly winding direction of spiral staircase 9*a* in adjacent building sectors 7 are vertically staggered from each other by the same vertical distances as the connecting passages.

As shown in the drawing, connecting passages 10 are uniformly distributed around staircase housing 9. Building sectors 7 are arranged about a common center and extend over identical angles with respect to the common center.

Figure 4:
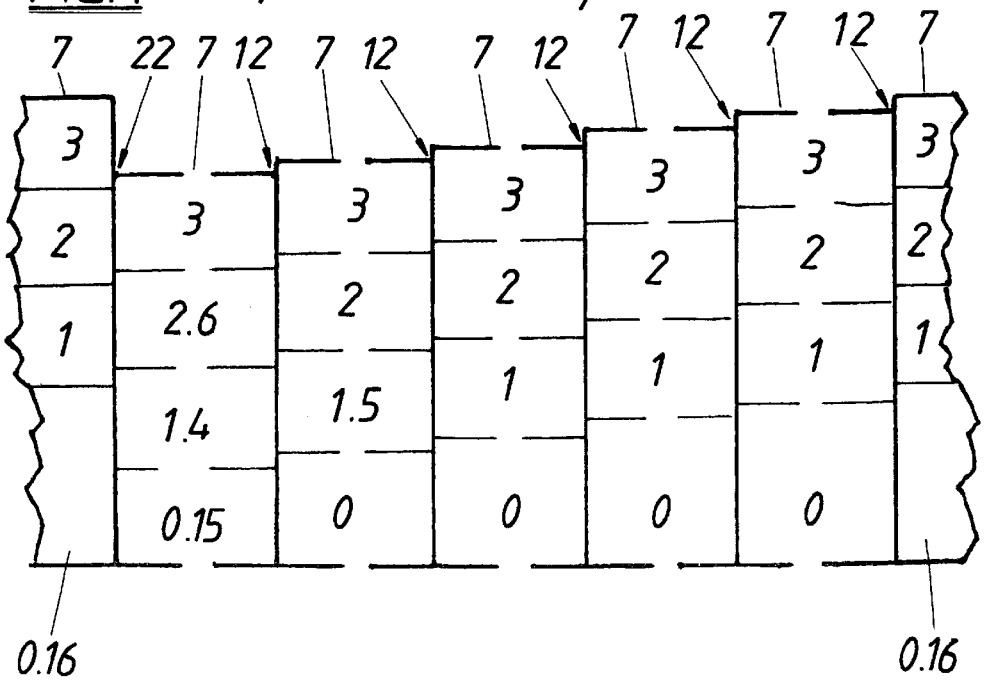
FIG. 4 is a diagrammatic side view of a hexagonal building, showing the vertically staggered stories in the adjacent building sectors.

FIG. 1 shows that the lowest ground floor 0.15 in one building sector 7 is adjacent to the highest ground floor 0.16 in the adjacent building sector, the ground floors continuously increasing in height in successive building sectors, as best shown in FIG. 4. With stories 1, 2 and 3 superposed on the ground floors and each other, respectively, to be vertically staggered from each other, this automatically causes the levels of the terraced roof-tops to differ from building sector to building sector, as shown at 12 and 22.

Access gallery 13 winds along all the stories at the courtyard side of the polygonal ring of building sectors 7 and, due to the vertically staggered arrangement of the stories in the adjacent building sectors, a few steps are provided at intersections 14 of the adjacent building sectors.

FIG. 2 shows staircase housing 9 at the center of the polygonal building structure, with connecting passages 10 radiating like spokes from the central staircase housing in courtyard 8 to building sectors 7. This pentagon shape illustrates best how the geometric form may be used to adapt to desired conditions. As far as the incidence of light is concerned, for example, it is most suitable if the apex points north.

In the above-described structure, upper stories 1, 2, 3, which are superposed on ground floors of constantly increasing height from one building sector to the adjacent building sector, automatically wind upwards in a spiral course. The difference in the height of the ground floors is determined on the basis of the number of building sectors forming the polygonal ring. For instance, in a hexagonal building structure, with an intended upper story height of 3 m and a height of 3 m for the lowest ground floor 0.15, the height of the highest ground floor 0.16 will be 5.5 m. The individual graduation of the heights of the ground floors in the adjacent building sectors results in the fact that, upon completion of one full cycle 1.4, the new cycle 2.6 will be on top of preceding cycle 1.4.

If architecturally desired or otherwise necessary because of a peculiar utilization, some building sectors may differ in size from other building sectors in certain polygons. In an octagon, for instance, the length of the building sectors facing each other may be of different length than the adjacent building sectors. However, in all embodiments, the building sectors must be of trapezoidal horizontal cross section.

When constructing the building of the present invention, it is appropriate to start with the erection of the vertical side walls of the trapezoid separating the adjacent building sectors. The vertically staggered ceilings/floors are then placed between the somewhat star-shaped walls of the building sectors. Such a structure is earth quake-proof.

Spiral staircase 9*a* starts at the ground level or comes up from a basement floor of a subterraneous parking garage and spirally winds upwards within housing 9. At the level of the first upper story 1.4, first connecting passage 11 leads from the staircase to story 1.4 which is on top of ground floor 0.15 of the lowest height. Second connecting passage 17, which is some steps higher, leads at an oblique angle from first connecting passage 11 to next higher story 1.5 in the adjacent building sector. After a complete helical cycle, the first connecting passage 18 of the succeeding cycle leads to the second upper story 2.6. The height of the connecting passages thus depends on the number of the stories in the building sectors around it. Exits 19 of staircase 9*a* provide access to the roofs of the structures holding the connecting passages, and these roofs lead to the roof-top terraces of building sectors 7.

The central staircase structure in an inner courtyard enclosed by the building sectors offers considerable advantages for the utilization of the building because the connecting passages may be used for various purposes, the distance to remote and opposite sectors of the building is optimized and shortened, and they improve the resistance to tectonic tremors, etc. In practice, it will depend on the concrete requirements and on architectural concepts if and how many passages lead from the central staircase to the surrounding building sectors. In a hexagonal building ring, it might be appropriate to build three crossings from the central staircase structure to the leg-side area of two adjacent trapezoidal building sectors, thereby providing access to two stories with a single corridor.

The dimensions of central staircase structure 9 as well as connecting passages 10 will to a large extent depend on the size and the intended utilization of the polygon building. In a very large residential complex, for example, it would make sense to size the connecting passages so as to create sufficient space for various activities. The central staircase housing may be large enough to hold an elevator or escalator, walkways and/or driveways. The terraced nature of the roof tops of the adjacent building sectors may be used for gardens, if desired, the graduation between adjacent sections of the roof top terraces providing excellent conditions for irrigation and drainage. The lowest roof top terrace 22 may be used for installing a water cistern.

Figure 3:
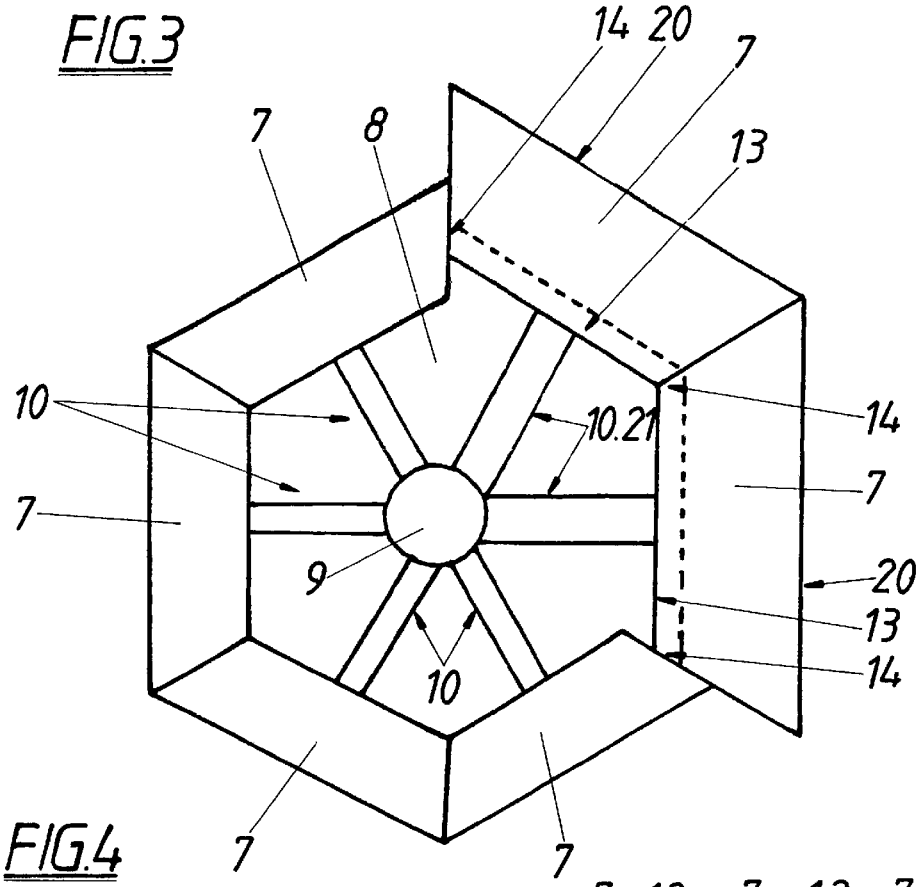
FIG. 3 is a plan view of a like building of hexagonal shape, including a group of expanded building sectors.

As shown in FIG. 3, one group 20 of building sectors 7 arranged in a hexagonal ring around central staircase housing 9 has a different distance from the common center than other building sectors 7. Access gallery 13 is shown in broken lines.

FIG. 4 diagrammatically illustrates the graduated heights of the ground floors 0.15 and 0 in the six adjacent building sectors 7 and the vertically staggered upper stories 1, 2, 3.

The above-described and illustrated construction offers maximum flexibility as far as employment of usable space is concerned. Without having to change the basic structure or layout of rooms, any desired total area may be chosen by expanding or constricting the inscribed ring or building circumference. The available surface area may be utilized to a very large extent for building since green plots and/or recreational facilities may be located in the inner courtyard, and parking may be provided underneath the inner courtyard in subterranean parking lots. The inner courtyard with the roofs on the spoke-like connecting passage structures gives residents many possibilities to style and organize this area individually and according to their requirements. The central staircase promotes communication between the residents in the separate building sectors. Formed as a pentagon, for example, the building can achieve a more efficient orientation, the largest side facing southwards while the small point faces northwards. As shown in FIG. 2, this construction assures optimal lighting conditions, i.e. an apartment located in the northeast sector faces southwest in the direction of the inner courtyard. As the trapezoidal building sectors have their smaller sides facing the courtyard while their wider sides face outwardly, it allows a maximum incidence of light towards the inside while broadening the view when looking towards the outside.

The closed ring structure of the building avoids extra outer walls needed in spaced-apart buildings. Access galleries 13 facing inner courtyard 8 may be roofed arcades winding spirally up from the ground floor to the roof top. Since leisure time and shopping facilities are desirable in large residential complexes, the ground floors of different heights provide optimal and varied space conditions for such facilities.

The ring building is extremely earth-quake proof. The adjoining building sectors support each other and are, furthermore, reinforced and held together with the central staircase structure by the spoke-like connecting passages. The spiral layout enables one to walk straight ahead to any story along the spiral staircase and the selected connecting passage and return the same way.

What is claimed is:

1. A building comprising (a) a plurality of multi-story building sectors, each building sector having a trapezoidal horizontal cross section and the building sectors forming a polygonal ring enclosing an inner courtyard, (b) a staircase housing in the inner courtyard, (c) a spiral staircase in the staircase housing, the staircase winding circularly in an upward direction, and (d) connecting passages radiating from the staircase to respective ones of the stories of the building sectors at staggered vertical distances, (1) successive stories in the upwardly winding direction of the spiral staircase in adjacent ones of the building sectors being vertically staggered from each other by the same vertical distances as the connecting passages.

2. The building of claim 1, wherein the connecting passages are uniformly distributed around the staircase housing.

3. The building of claim 1, wherein the building sectors are arranged about a common center and extend over identical angles with respect to the common center.

4. The building of claim 3, wherein at least one group of building sectors has a different distance from the common center than other building sectors.

* * * * *